US008633815B2

(12) United States Patent
Al-Harbi et al.

(10) Patent No.: US 8,633,815 B2
(45) Date of Patent: Jan. 21, 2014

(54) SYSTEM FOR DETECTING AND IDENTIFYING TRAFFIC LAW VIOLATORS AND ISSUING CITATIONS

(76) Inventors: Harmad S. H. S. Al-Harbi, Surra (KW); Dheya Ali Mohammad Al-Fayez, Kaifan (KW)

( * ) Notice: Subject to any disclaimer, the term of this patent is extended or adjusted under 35 U.S.C. 154(b) by 210 days.

(21) Appl. No.: 13/151,469

(22) Filed: Jun. 2, 2011

(65) Prior Publication Data

US 2012/0306640 A1 Dec. 6, 2012

(51) Int. Cl.
*G08B 1/08* (2006.01)

(52) U.S. Cl.
USPC ..... 340/539.11; 340/5.86; 340/901; 340/905; 340/936; 340/988; 342/113

(58) Field of Classification Search
USPC ..... 340/5.86, 539.1, 539.11, 901, 905, 988; 342/113
See application file for complete search history.

(56) References Cited

U.S. PATENT DOCUMENTS

| | | | | |
|---|---|---|---|---|
| 5,041,828 | A | 8/1991 | Loeven | |
| 5,122,802 | A * | 6/1992 | Marin | 342/13 |
| 5,515,042 | A | 5/1996 | Nelson | |
| 6,188,329 | B1 * | 2/2001 | Glier et al. | 1/1 |
| 6,342,830 | B1 * | 1/2002 | Want et al. | 340/10.1 |
| 6,437,690 | B1 * | 8/2002 | Okezie | 340/505 |
| 6,696,978 | B2 | 2/2004 | Trajkovic et al. | |
| 6,914,541 | B1 | 7/2005 | Zierden | |
| 8,525,644 | B1 * | 9/2013 | Yonekura et al. | 340/5.86 |
| 2002/0107634 | A1 | 8/2002 | Luciani | |
| 2002/0186297 | A1 * | 12/2002 | Bakewell | 348/118 |
| 2003/0052797 | A1 * | 3/2003 | Rock et al. | 340/936 |
| 2003/0095688 | A1 * | 5/2003 | Kirmuss | 382/105 |
| 2003/0125981 | A1 * | 7/2003 | Pedrazzoli Pazos | 705/1 |
| 2003/0200227 | A1 * | 10/2003 | Ressler | 707/104.1 |
| 2005/0088320 | A1 * | 4/2005 | Kovach | 340/933 |
| 2006/0214783 | A1 * | 9/2006 | Ratnakar | 340/505 |
| 2007/0257814 | A1 * | 11/2007 | Tilton et al. | 340/901 |
| 2008/0169970 | A1 * | 7/2008 | Woodcox et al. | 342/113 |
| 2008/0212414 | A1 * | 9/2008 | Mardirossian | 368/90 |
| 2008/0221916 | A1 * | 9/2008 | Reeves et al. | 705/1 |
| 2011/0133952 | A1 * | 6/2011 | McNamara et al. | 340/905 |
| 2012/0302348 | A1 * | 11/2012 | Karacal et al. | 463/38 |

* cited by examiner

*Primary Examiner* — Benjamin C Lee
*Assistant Examiner* — Chico A Foxx
(74) *Attorney, Agent, or Firm* — Lowe Hauptman & Ham, LLP

(57) ABSTRACT

A system for automatically monitoring traffic, identifying vehicles traveling in violation of predetermined regulations and for automatically and immediately issuing traffic citations includes an audio or visual signal to the operator of the motor vehicle that they are in violation of regulations and receiving a citation. A printer is included in the vehicle and activatible from a remote station to immediately print the citation. A vehicle disposed receiver/transmitter/comparator includes ownership data that is transmitted to a remote station together with operating data that may result in an infraction.

3 Claims, 4 Drawing Sheets

SYSTEM FOR DETECTING AND IDENTIFYING TRAFFIC LAW VIOLATORS AND ISSUING CITATIONS

FIELD OF THE INVENTION

This invention relates to a system for identifying and detecting motor vehicles, their owners and any outstanding citations and more particularly to a system for identifying a motor vehicle that has being operated in an unlawful manner and for immediately and automatically identifying the stolen vehicle.

BACKGROUND FOR THE INVENTION

The system in accordance with the present invention also automatically checks for expired insurance and registrations and notifies police officers that the car should be stopped and prevented from continued use until insurance and registration are reinstated. The system also automatically compares license plate tag numbers with vehicle identifications to identify stolen vehicles. Further, the stored information in the systems is accessible with the present invention and may be immediately accessed to aid a policemen investigating an accident and/or making a stop in response to a visual infraction. This invention can also help a police officer in recording manually the traffic violations of the vehicles quickly without the need of entering any data (it is only by pressing one button) with the time and location of where the traffic violations were taken and then printing out in the same time if needed a copy for the driver of the violation with all the details. In fact, the policemen can record the traffic violations while driving a police car without stopping or any needed help from partners. There is also the advantage that the invention is directly connected to the main responsible traffic department for any other relevant department and the traffic violation can immediately be sent to that department wherein all the data is stored.

It should be recognized that no one even the policeman can change any stored information. In effect the police officer is a watcher and no one can change/delete/add information without authorization and a password. This will protect the integrity of the collected information. The invention uses a USB connection for data entry, but not through a portable device but is only possible through the connected police department or other proper authorization. The detection machine in accordance with the present invention doesn't detect the speed of a passing vehicle. When there is excess of speed, the police officer will direct the remote to the metal plate number of the vehicle which includes a chip that reveals the serial number to detect it quickly and then all the need information of the car owner appears to the police officer so that he issues a traffic law violation and sends it immediately and automatically to the central motor vehicle department.

The police officer can record the traffic violations during the operation of his vehicle without stopping or without needing help from a partner. That the invention is directly connected to the main responsible traffic department and the traffic violation can immediately be sent to that department with a copy in the driver's file with all the necessary data.

Finally, it is presently believed that the system in accordance with the present invention will be relatively inexpensive to manufacture, can be sold at a competitive cost, will be easy to install and service, durable, reliable and relatively easy to add information and programs.

BRIEF SUMMARY OF THE INVENTION

In essence, the present invention contemplates a system for automatically identifying vehicles that are entering a restricted area or being operated without insurance or current registration. In a preferred embodiment of the invention, the system includes storage means within the motor vehicle, The storage means includes a chip for storing information including vehicle identification number, ownership data i.e. name and address, registration number and insurance data including expiration date of the policy.

The system also incorporates a remote receiver/transmitter/comparator adjacent to a road, in a police car or in a hand held unit in the hands of a police officer or the like.

The a remote receiver/transmitter/comparator send signals to the metal plate number of the passing vehicle then an audio or visual signal appear to the police officer or central office when there is violation for example the date of insurance expiration.

The detection machine will not detect the speed of the passing vehicle when there is an over speed, as for example, by a separate speed camera or radar device, the police officer will direct the remote to the metal plate of the vehicle to obtain the serial number quickly. Then all the information of the car/owner appears to the police officer so that he can issue a traffic law violation and send it directly and automatically to a central motor vehicle department.

The detecting machine has other useful usages; it can record and count the vehicles at areas of interests. Also it is very helpful when the police officer needs to get information of a vehicle/owner, instead of auditing each vehicle/owner by checking the license and comparing the information with a laptop by entering the name or vehicle's number which leads to a lists of vehicles and closing a main or sub street. By this machine all the information will be continuously updated from the main source (Ministry of interior or the concerned police department) when any changes occur such as adding data or if there is announcement or violation, the detection machine will give a voice to alert the police officer that the passing vehicle should be stopped. It is also useful to be fixed at the entrance of an assembly for military vehicles to detect them automatically and save the date/time accurately of each vehicle, in future this data may mean something when inquiries, also it is easier by the detection machine to count the number and record quickly the information of every vehicle that enters through the gates of castles or the like during periods of heavy traffic.

The invention will now be described in connection with the accompanying drawings wherein like reference numerals have been used to identify like part.

DESCRIPTION OF THE PREFERRED EMBODIMENTS OF THE INVENTION

Figure 1:
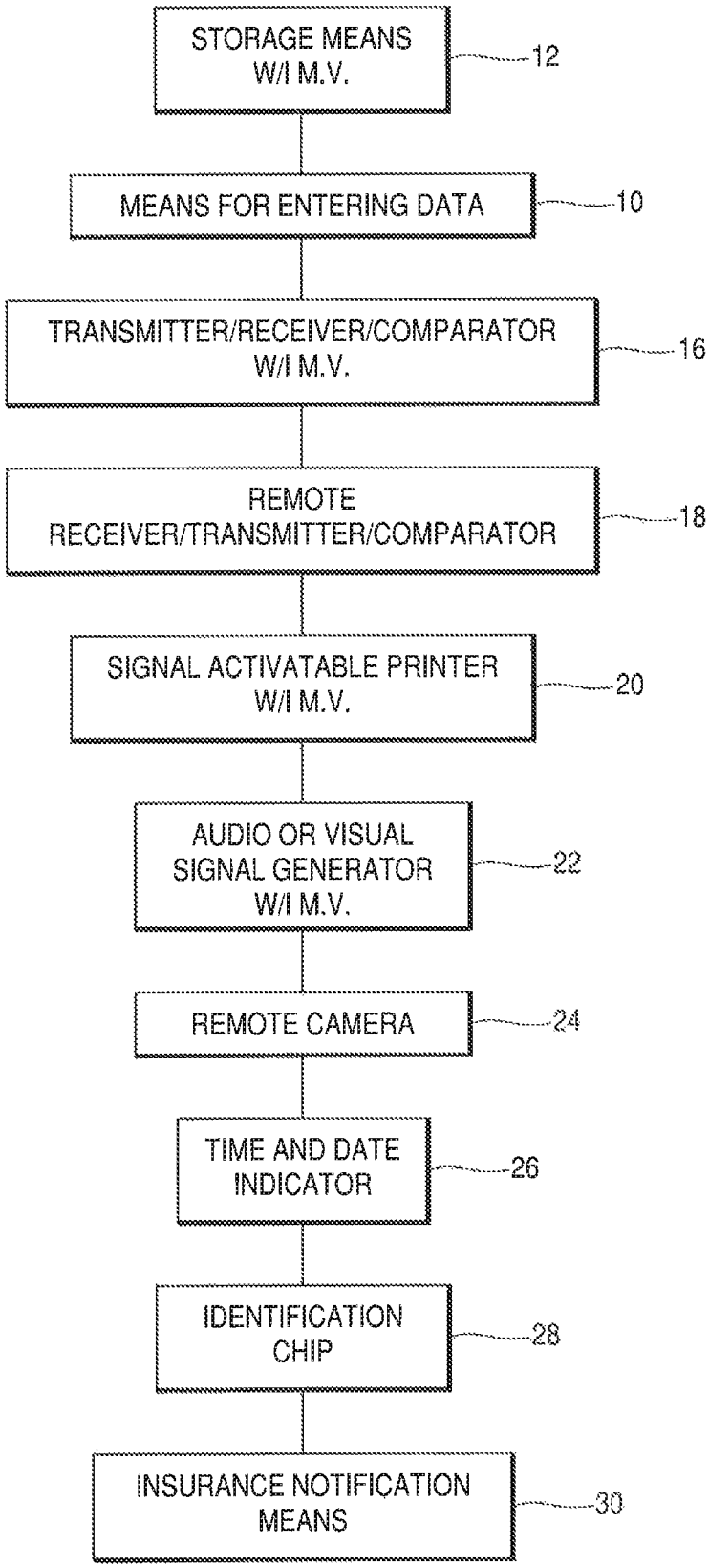
FIG. 1 is a schematic block diagram illustrating the elements in a system in accordance with the present invention.

A system for detecting and identifying traffic violators and automatically issuing traffic citations will now he described with reference to FIG. 1. As shown in FIG. 1, the system 10 in accordance with a preferred embodiment of the invention includes storage means 12 such as a data memory chip or mini-computer, flash drive and the like that can be disposed within a motor vehicle. The system also includes means 10 for entering data into the computer as for example a USB port for inputting data into the storage means 12.

Transmitting receiving means as for example a transmitter receiver 16 is also disposed within the motor vehicle.

The system 10 also includes a remote receiver/transmitter/comparator 18 which may be disposed in a police car, adjacent a road or in the hands of a police officer. The remote receiver/transmitter/comparator includes a detector or means for inputting regulations. The remote receiver/transmitter/comparator also includes a receiver for receiving a GPS signal to incorporate the location where the violation or other regulations are being monitored, the remote receiver/transmitter/comparator records that information together with the received information on the vehicle's owners identification and address and/or the driver's information, issues a citation and at the same time notifies the proper authorities as for example the register of motor vehicles. The present invention dose not detect the speed of a vehicle until such time as a police officer gives an order to do so.

A signal activatible printer 20 is disposed in the motor vehicle and is activatible by a signal from the remote receiver/transmitter/comparator 18. For example, when the remote receiver/transmitter/comparator 18 detects for parking violation of a vehicle in a not allowed car park, the receiver/transmitter/comparator records the information and issue a citation by printing the citation with, the vehicle identification, owner's address information and fine or other action to be taken by the operator of the motor vehicle. The remote receiver/transmitter/comparator also sends a notice and/or copy of the citation to the local motor vehicle department for recording and further processing.

In addition to the above system 10 and printer 20, may indicate a location as well as the time and data stamp 26 that is printed by the printer 20 on each citation. It is also contemplated that the storage means 12 includes an identification chip 28 that records insurance information 30 as for example the data of expiration. The system 10 may also include the location and time of traffic violation.

Figure 2:
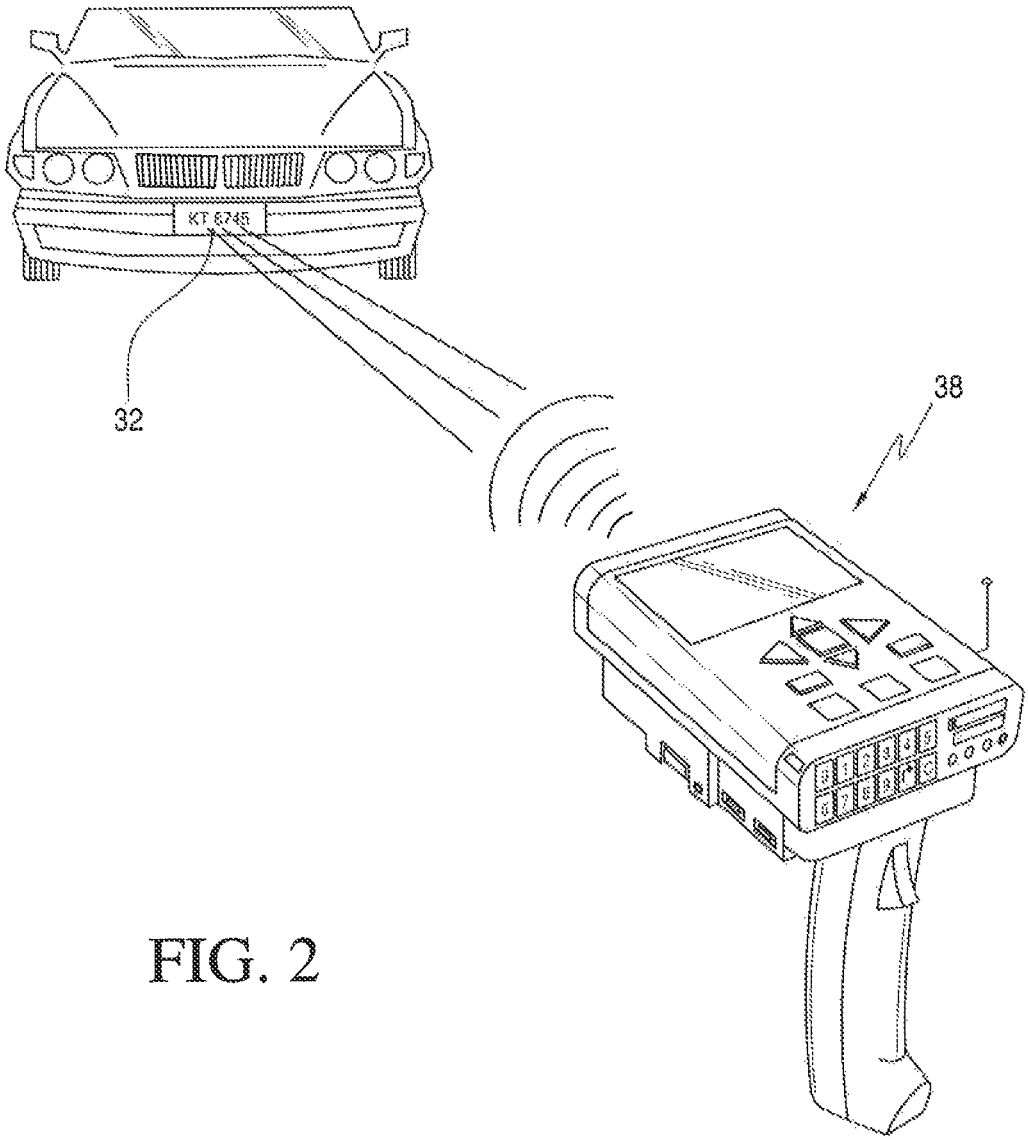
FIG. 2 is a schematic illustration of a chip that includes data about the vehicle/ownership of a motor vehicle displayed on the front plate number of a motor vehicle.

A further embodiment of the invention is illustrated in FIG. 2 wherein a transponder 32 transceiver or the like is mounted on a front portion of a motor vehicle. As shown, the transponder transceiver or the like 32 is mounted on a license plate. Using the license plates may help provide clear detection by a remote receiver/transmitter/comparator 18 (FIG. 1), In a preferred embodiment of the invention the chip will be fixed or mounted on the front and rear license plate of the automobile plates number only.

Figure 3:
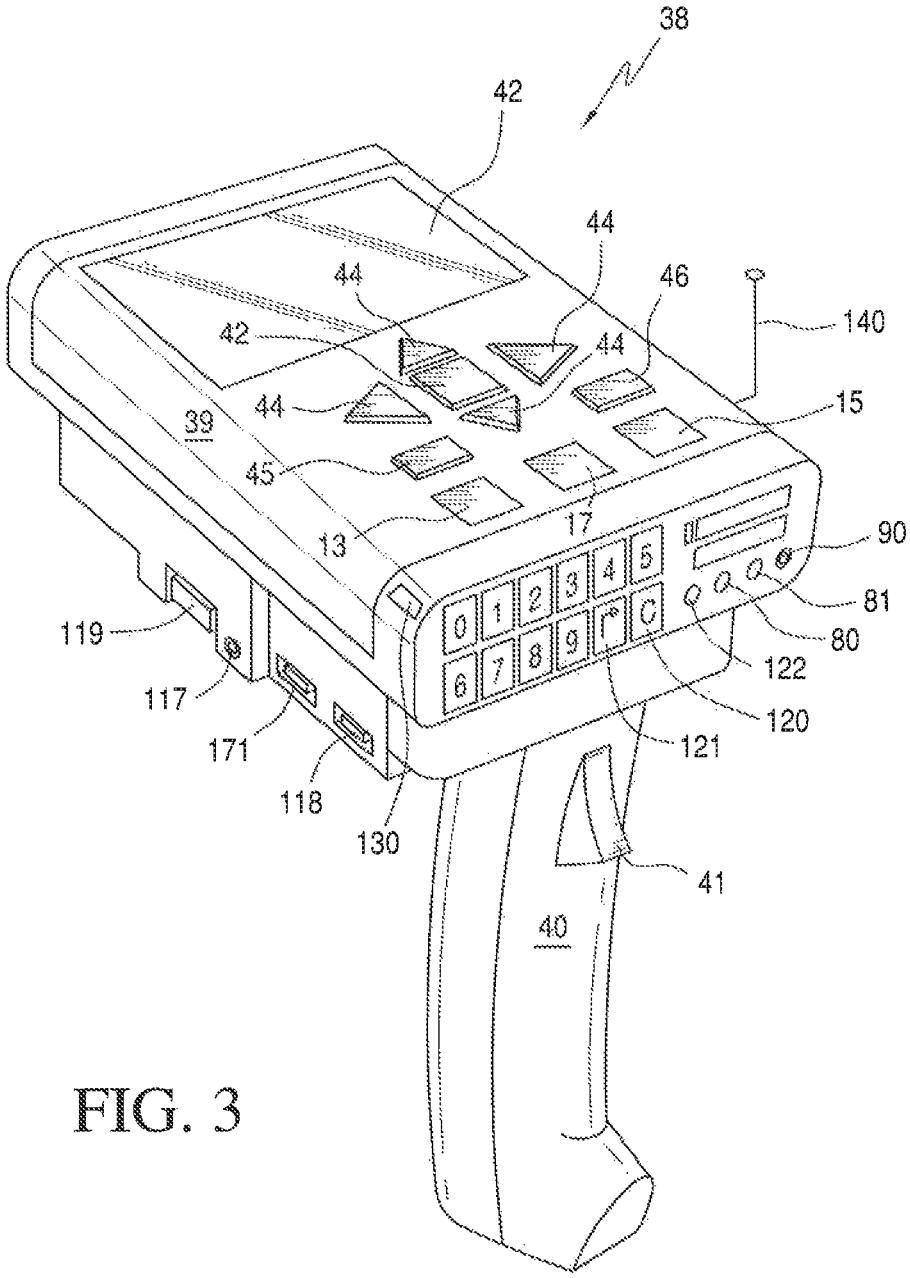
FIG. 3 is a perspective view of a hand held receiver/transmitter/comparator of the type used in the present invention.

A further embodiment of the invention namely a hand-held remote receiver/transmitter/comparator is shown in FIG. 3. As shown, a hand-held remote receiver/transmitter/comparator 38 includes a housing 39 and generally vertical handle 40 fixed to the housing 39. The handle 40 also includes a trigger 41 for activating the device in a manner that is similar to hand-held radar or laser devices conventionally used. The housing 39 includes an LCD monitor 42 in an upper surface thereof for displaying information received or entered into the system. An up and down right and left arrow buttons 44 are also provided on the upper surface of the housing. In addition, a print button 45 and cancel button 46 are also provided for printing a copy or canceling information such as citation for a moving vehicle together with an identification of the vehicle owner and other data.

In addition, the remote receiver/transmitter/comparator unit includes an output socket 119 on the side of the housing 39 for connecting a printer to the receiver/transmitter/comparator 38 for making a hard copy of issued citations and a UST port 117 for connection to another device. Optional parts 171 and 118 are also provided in the side of the housing 39.

An alarm 130 such as a red light, is provided on an upper forward portion of the housing 39 to indicate a more serious infraction such as greatly exceeding the speed limit or perhaps a stolen vehicle that warrants a traffic stop that is then broadcast to police vehicles in the vicinity by means of a wireless unit and aerial 140.

A key pad including numbers 1-9 are provided in the front of the housing 39 to input a security code to obtain access to use the unit. Further, inputting an officer's security access will also identify the officer who issued the citations issued by the unit. Further, keys 120 and 121 allow an officer to make a correction i.e. delete a portion of an inputted security code and then enter the password. In other words, bars 5A and 6A provide access to a reader for data memory and to copy information to a memory card.

The front of the housing 39 also includes a warning light 90 that indicates a low battery as well as an input 80 for a battery charger. An on/off switch 80 and indicator light 81 indicates that the batter is completely charged and an electrical connector 122 allows the device to be connected to an alternate source of power such as a cigarette lighter socket in a motor vehicle.

Finally, the hand held receiver/transmitter/comparator 38 may include three additional buttons 13, 15 and 17, as for example, a switch 17 to update the system, a switch 13 to detect switch, and a button or switch 15 to direct an inquiry to a central office.

Figure 4:
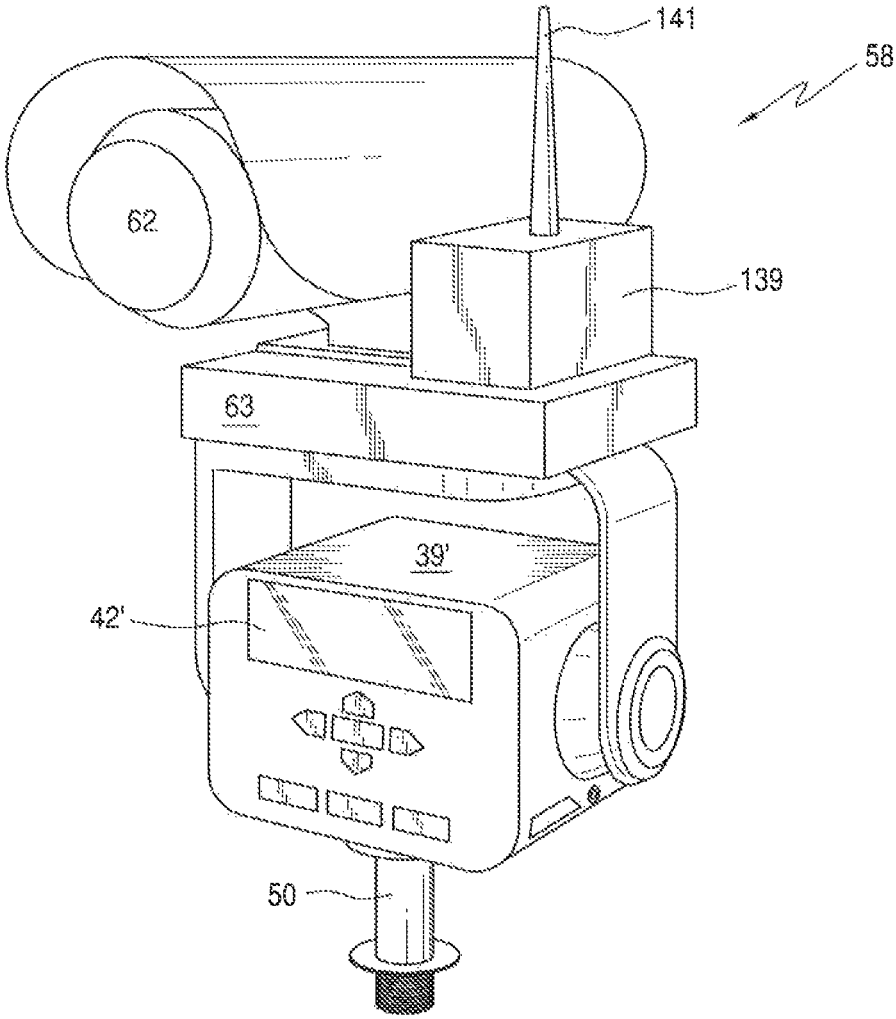
FIG. 4 is a schematic illustration of a remote receiver/transmitter/comparator for monitoring traffic by a system in accordance with the present invention.

It is also contemplated that a receiver/transmitter/comparator 58 (FIG. 4) may be mounted or fixed to a post 50 adjacent to an important entrance, for example, a royal castle, hotels, oil stations, ministry of interior, ministry of defense, native safeguard etc. and all areas which need fast and express and in the same time accurate registration of the vehicles passing through an entrances. The receiver/transmitter/comparator includes and a holder 63 to fix the detector on it, Further, a separate transmitter receiver 139 and antenna 141 are provided. A housing 39' and monitor 42' are similar to those in the hand held device but may require an access code for actuation by a police officer who is located with the device adjacent entrances, While the invention has been described in connection with its preferred embodiments it should be recognized that changes and modifications may be made therein without departing from the scope of the appended claims.

What is claimed is:

1. a hand-held remote receiver, transmitter, and comparator device for identifying a motor vehicle, identifying its owner and record of violations and outstanding infractions and immediately issuing a citation for violations of predetermined regulations including:

a housing, including a receiver, transmitter and comparator disposed in said housing and including an LCD monitor in an upper surface of said housing for displaying information received or entered into the device, up and down: right and left arrow buttons provided on the upper surface of the housing, a print button and cancel button for printing a copy of a citation and canceling information;

a vertical handle fixed to said housing including a trigger for activating said device;

an output socket on a side of said housing for connecting a printer to the said receiver, transmitter and comparator for making a hard copy of an issued citation and a USB port for connection to another device;

and wherein said receiver is adapted to receive GPS signals indicating location where an infraction occurred;

an alarm including a red light disposed on an upper forward portion of said housing to indicate a more serious infraction including a stolen vehicle that warrants a traffic stop that is then broadcast to police vehicles in the vicinity;

a remotely actuable printer disposed in a motor vehicle and actuated from said remote receiver, transmitter and comparator device;

and wherein a copy of the citation to the driver is printed by said remotely actuable printer includes the location as well as a time and date printed on each citation;

a key pad including numbers 1-9 disposed in the front of the housing to input a security code access to use said remote receiver, transmitter and comparator device and to identify an officer who issues a the citation via said remote receiver, transmitter and comparator, means for allowing an said office to make correction;

a warning light that includes a low battery and an input for a battery charger;

an on/off switch and an indicator light indicates that the battery is fully charged and an electrical connector allows the device to be connected to an alternate source of power; and means for directing an inquiry to a central office.

2. A hand-held remote receiver, transmitter and comparator device for identifying a motor vehicle, identifying its owner and record of violations and outstanding infractions and immediately issuing a citation for violations of predetermined regulations according to claim 1, in which said device includes means for fixing said device to a post adjacent to an important entrance.

3. A hand-held remote receiver, transmitter and comparator device for identifying a motor vehicle, identifying its owner and record of violations and outstanding infractions and immediately issuing a citation for violations of predetermined regulations according to claim 2, in which said device requires an access code for actuation by a police officer for use of said device.

* * * * *